United States Patent [19]

Jaseck et al.

[11] 4,173,901

[45] Nov. 13, 1979

[54] BALL JOINT AND POLE ASSEMBLY FOR STARTER MOTOR

[75] Inventors: James E. Jaseck, Madison Heights; Alex M. Pentland, Ann Arbor, both of Mich.

[73] Assignee: Ford Motor Company, Dearborn, Mich.

[21] Appl. No.: 927,207

[22] Filed: Jul. 24, 1978

[51] Int. Cl.[2] ..... F02N 11/02

[52] U.S. Cl. ..... 74/6; 123/79 R; 290/38 R

[58] Field of Search ..... 74/6, 7 R, 7 A; 290/36 R, 38 R, DIG. 1; 123/79 M

[56] References Cited

U.S. PATENT DOCUMENTS

| | | | |
|---|---|---|---|
| Re. 28,052 | 6/1974 | Erwin | 290/38 R |
| 2,542,712 | 2/1951 | Schneider et al. | 290/38 R |
| 2,813,206 | 11/1957 | Jensen | 74/7 R |
| 2,839,935 | 6/1958 | Hartzell | 74/7 A X |
| 2,923,830 | 2/1960 | Merriam et al. | 290/38 R |
| 3,030,518 | 4/1962 | Jensen | 290/36 R |
| 3,708,682 | 1/1973 | Erwin | 290/37 |
| 3,774,047 | 11/1973 | Erwin | 290/38 R |
| 3,974,703 | 8/1976 | Strozinski | 74/6 |

FOREIGN PATENT DOCUMENTS

| | | | |
|---|---|---|---|
| 190743 | 8/1956 | Austria | 74/7 A |

*Primary Examiner*—Thomas J. Holko

*Attorney, Agent, or Firm*—Peter Abolins; Clifford L. Sadler

[57] ABSTRACT

This specification discloses an automobile starter motor having a lever pivotally coupled to the housing of the starter and movably supporting a pole piece so that energizing the starter causes the pole piece to move toward the housing and to align to seat against the housing. The connection between the lever and the pole piece is a ball joint connection which permits relative movement between the pole piece and the lever so that there is maximum engagement between the housing and the pole piece which increases the starter holding force by reducing flux path reluctance and equalizing flux distribution through the extremities of the pole piece, and simplifies manufacturing, by reducing solenoid power and thus coil windings required and by eliminating a rigid connection between the pole piece and lever.

10 Claims, 4 Drawing Figures

BALL JOINT AND POLE ASSEMBLY FOR STARTER MOTOR

FIELD OF THE INVENTION

This invention pertains to automobile starter motors and, more particularly, to a coupling between the pole piece and the remainder of the starter motor.

PRIOR ART

Automobile starter motors are electrical motors which are mounted to the automobile engine for selectively coupling the starter motor armature with the fly wheel which conventionally is connected to the engine crank shaft. During use of the starter motor to crank the engine, the starter motor armature shaft is coupled to the fly wheel by a pinion or starter drive gear which is slidable along the starter motor armature shaft into and out of engagement with gear teeth defined on the rim of the fly wheel. The pinion gear normally is biased by a suitable spring out of engagement with the fly wheel. The pinion gear is moved into engagement with the fly wheel by the operation of a solenoid which is energized during energization of the starter motor itself.

The solenoid may be provided independently of the field coil in the starter motor, or the solenoid may have its winding formed by at least a part of one of the motor field coils. In either case, the starter motor includes a magnetic pole piece cooperating with the solenoid. Typically, the pole piece is mounted on a lever which is pivotally mounted to the housing so that the pole piece can pivot into an opening in the housing during starting and can move to a position out of the opening during conditions when a starter motor is not being used. The movement of the pole piece on the associated lever assembly causes movement of the starter drive gear along the starter armature to engage the starter to the engine. After the starter engages the engine, continued operation of the starter will cause turning of the engine.

The magnetic field developed to attract the pole piece must be sufficient to hold the pole piece in the opening in the housing so that the starter continues to engage the engine. If the magnetic force is not sufficient to hold the pole piece, the latter will periodically slip out. In some starter designs, movement of the pole piece out of its operative position reestablishes a magnetic field and causes the starter motor to operate intermittently or to "chatter". Chatter causes a high current to pass through switch points carrying current to the magnetic field and causes undesirably rapid wear of the switch points. There must also be provided sufficient force to overcome manufacturing variations which tend to reduce the force of the magnetic field attracting the pole piece to the housing. That is, the pole piece is typically fixedly attached to the lever so that a misalignment between the housing and the pole piece causes a reduction in magnetic flux. The reluctance of the flux path from the winding through the housing and the pole piece is increased so that in order to achieve sufficient pulling force, the magnitude of the field must be increased. The need for increased hold-in force with an improperly seated pole piece can be appreciated when considering the ease with which a flat magnet can be pryed off a flat surface by lifting one corner instead of removing the magnet from the surface at once. In an effort to overcome starter problems associated with the "pulling in" and "holding" of the pole piece against the housing, various solutions have been proposed.

As previously mentioned, the field coils can be made sufficiently strong to insure pull-in of the pole piece. This is disadvantageous because extra windings must be used. After pull-in has occurred, the pole piece must continue to be held in. This "hold-in" problem becomes particularly acute when the engine is on the verge of running and the load on the starter is reduced thus decreasing current through the field coils. The resulting decrease in the field coil generated magnetic field can release the pole piece. To increase the "hold-in" force, it is known to add a separate coil to increase the number of ampere turns. However dedicating or adapting field coils to provide a hold-in or a pull-in force is undesirable because the magnetic field which most efficiently pulls in a pole piece is not necessarily the same as the magnetic field which most efficiently turns the armature when the starter is cranking. Thus, to achieve sufficient "pull-in" and "hold in" force, there is a need for an undesirable amount of solenoid winding material or a separate winding which increases manufacturing difficulty and cost, uses more material for the windings and adds to the weight of the starter thus increasing vehicle weight when efforts are being made to reduce vehicle weight. These are some of the problems this invention overcomes.

SUMMARY OF THE INVENTION

This invention recognizes that the problem of maintaining a sufficient magnetic force for achieving pulling and holding of a movable pole piece with respect to a starter housing can be solved, if desired, without the use of additional windings and without a need for a substantial field windings required for normal operation of the starter. In accordance with the embodiment of this invention a pole piece is coupled to a lever assembly by means of a ball joint connection. Such a connection compensates for manufacturing variations and tolerances in the assembly of the pole piece to the lever and of the lever to the starter housing so that there is a maximum seating of the pole piece on the starter housing. With such seating, the flux path reluctance is reduced and there is an increase in starting holding force. One result is that the need for a starter field shunt coil can be eliminated. Additionally, there can be an elimination of the welding step whereby the pole piece is fixedly secured to the lever. Thus, not only can there be a material saving in the manufacture of a coil for the starter but also in the manufacturing process forming the lever and pole assembly. Performance of the starter can be improved by utilizing the space formerly occupied by the starter field shunt coil to have a more efficient winding to be used during the cranking portion of the starter motor cycle. Further, improved seating of the pole piece can reduce the air gap between the armature and the pole piece thus reducing reluctance of the total magnetic path.

In accordance with an embodiment of this invention, coupling means connecting the pole of an automobile starter motor to the lever coupling the pole to a housing for the starter motor, includes a ball joint means for providing an adjustable coupling. A post means extends outwardly from the ball joint means and is attached to the pole. The lever means has an opposing clamp means for receiving therebetween the ball joint means. For example, the lever can include two side by side parallel plates having a pair of opposing indentations for receiving the ball. As a result, the pole can pivot with respect to the lever means and abutment of the pole against the housing aligns the pole with the housing thereby compensating for manufacturing tolerances and reducing flux path reluctance.

DETAILED DESCRIPTION OF THE INVENTION

Figure 1:
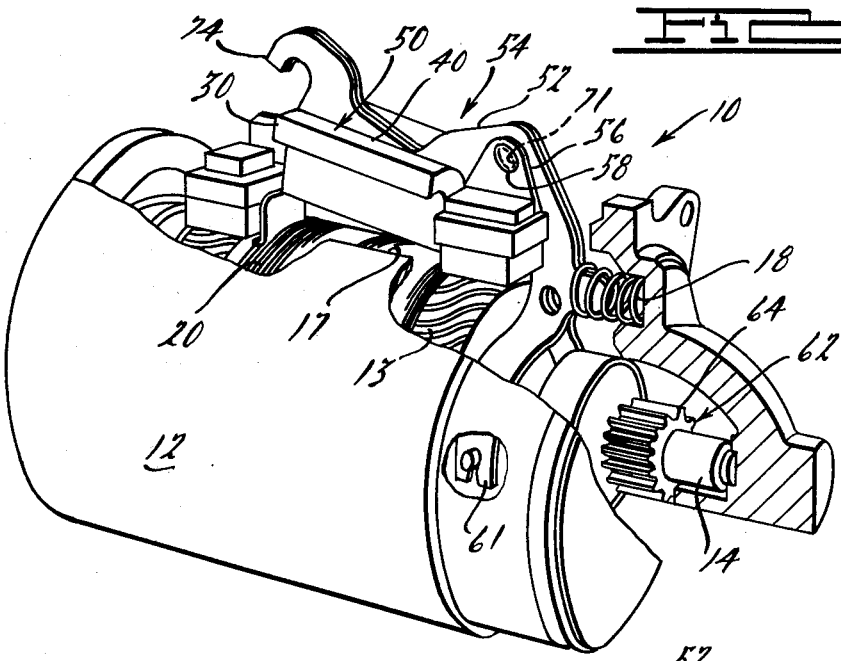
FIG. 1 is a front perspective, partly broken, view of an automobile motor in accordance with an embodiment of this invention.
Figure 2:
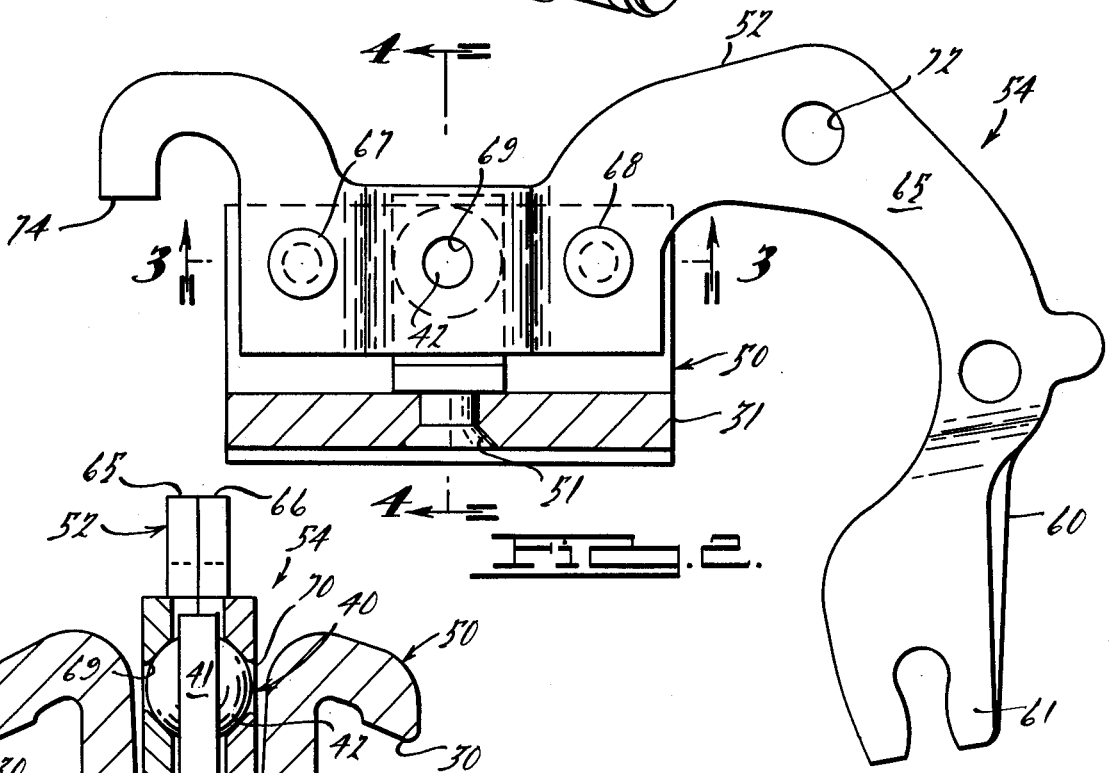
FIG. 2 is a side elevation view, partly broken, of a control assembly including a lever and a pole piece in accordance with an embodiment of this invention.

Referring to FIG. 1, an automobile starter motor 10 includes a cylindrical housing 12 in which is contained a conventional commutator-armature assembly 13 (hereinafter referred to as armature 13). Armature 13 is defined about a shaft 14 which is made to rotate in response to flow of current through field coils 20 mounted within housing 12. A field pole 50 is movably mounted so that it can align with the outer surface of housing 12 and provide advantages not available with a fixed mounting. An opening 17 receives a portion of pole piece 50 and housing 12 adjacent opening 17 engages and aligns pole piece 50.

Referring to FIGS. 1 through 4, a control assembly 54 includes a field pole 50 carried on the underside of a lever arm 52. Lever arm 52 is generally L-shaped in side profile and includes two symmetric, elongated, generally planar members 65 and 66 which are connected to each other by a pair of rivets 67 and 68. Lever arm 52 is hinged adjacent the bend in the "L" to the outer surface of housing 12 by means of a hinge bracket 56 having aligned mounting holes 71. A hinge pin 58 is positioned through holes 71 and a hole 72 in lever arm 52. The portion of lever arm 52 extending parallel to the axis of housing 12 carries field pole 50. Lever arm 52 includes a fork section 60 extending from hinge pin 58 wherein symmetric members 65 and 66 extend away from one another so they are on opposite sides of housing 12 and of a drive gear assembly 62 slidably mounted on armature shaft 14 for rotation therewith, but selectively movable along the axis of the shaft. The extremity of each symmetric member 65 and 66 includes a fork end 61 for engaging and moving drive gear assembly 62.

More specifically, drive gear assembly 62 includes a gear 64 for engaging a corresponding gear on a fly wheel of an automobile engine with which starter motor 10 is used. Mounted to drive assembly 62 are a pair of lips extending on opposite sides thereof and positioned to engage fork end 61 of fork 60. Movement of fork end 61 is designed to cause movement of these lips and thus control the axial position of gear 64 along armature shaft 14.

Rivets 67 and 68 extend through members 65 and 66 at spaced positions in the portion of lever arm 52 extending away from fork 60. Between rivets 67 and 68, member 65 has an opening 69 therethrough and member 66 has an opening 70 therethrough. Openings 69 and 70 are aligned with each other to receive a ball joint assembly 40 which is attached to pole piece 50 so that pole piece 50 can pivot with respect to lever arm 52. Openings 69 and 70 have opposing generally concave surfaces for following the outer surface of a ball 42 of ball joint assembly 40. Rivets 67 and 68 hold members 65 and 66 together with sufficient force so that vibrational forces do not cause relative movement between lever arm 52 and ball 42. However, members 65 and 66 do not exert sufficient force on ball 42 to prevent pole piece 50 from aligning with housing 12 when starter motor 10 operates. Fork 60 is normally biased rearwardly to a pivotal position shown in FIG. 1 by the action of a compression spring 18 fixed between housing 12 and fork 60. In the normal rearward position of fork 60, lever arm 52 is correspondingly inclined upwardly at a free end 74, thereby keeping pole piece 50 out of the center of coil 20.

Figure 4:
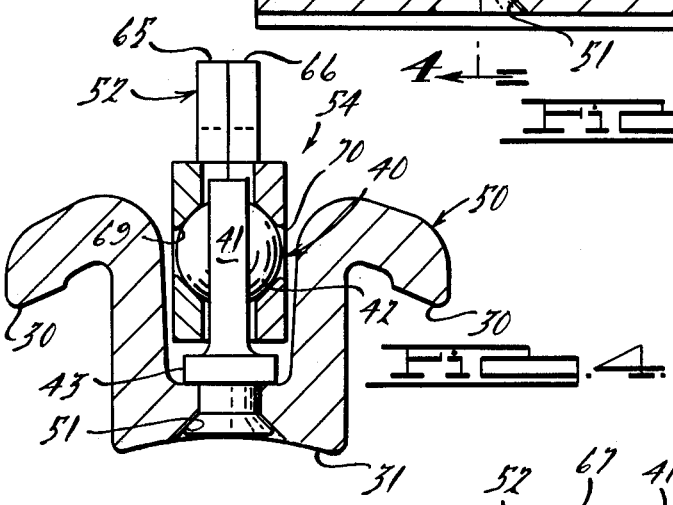
FIG. 4 is a partly sectional view taken generally along line 4—4 of FIG. 2.
Figure 3:
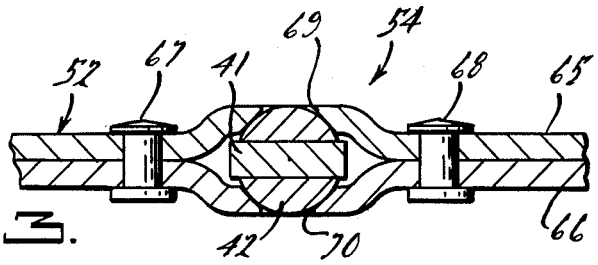
FIG. 3 is a partly sectional view taken generally along line 3—3 of FIG. 2.

Ball joint assembly 40 includes generally spherical ball 42 through which extends an elongated stem 41. Stem 41 is generally parallel to a diameter of ball 42 and has one end extending sufficiently away from ball 42 so that it can be received by the bottom of a U-shaped pole piece 50. The end of stem 41 engaging pole piece 50 can have a deformable rivet-like head. Advantageously, stem 41 includes a shoulder 43 extending transversely outwardly from stem 41 to limit travel of pole piece 50 up stem 41 toward lever arm 52 (FIG. 4). Thus, a minimum clearance can be maintained between pole piece 50 and lever arm 52 so that there can be relative rotational movement.

Pole piece 50 is elongated and generally U-shaped in transverse cross section with outwardly and downwardly extending tips of the U-shaped denoted wings 30 (FIG. 4). A bottom portion 31 of U-shaped pole piece 50 has an opening 51 therein, parallel to the arms of U-shaped pole piece 50 for receiving a stem 41. Opening 51 generally tapers toward lever arm 52 so that when stem 41 is deformed in opening 51, the taper resists relative movement between pole piece 50 and stem 41 in one direction and shoulder 43 resists relative movement in the other direction. Bottom portion 31 is sized to be received within opening 17 in housing 12. Wings 30 extend beyond the edges of opening 17 and engage the outside surface of housing 12. Thus, the entire length of the outermost extremities of wings 30 can be in contact against housing 12. Pole piece 50 is formed of magnetically attractable material.

OPERATION

When starter motor 10 is not activated, spring 18 biases lever arm 52 so that pole piece 50 is spaced from housing 12. Energizing field coils 20 by passing an electric current creates a magnetic field which attracts pole piece 50. Accordingly, lever arm 52 pivots forwardly about hinge pin 58 and fork end 61 pushes against the lips of drive assembly 62, thereby moving the assembly forward along shaft 14 until gear 64 engages the engine fly wheel.

Forward pivoting of lever arm 52 continues as bottom portion 31 of U-shaped pole piece 50 enters opening 17 in housing 12. Forward pivoting stops when wings 30 engage housing 12. There is sufficient magnetic force attracting pole piece 50 to field coils 20 that ball joint assembly 40 pivots with respect to lever arm 52. That is, for reduced reluctance of the flux path including housing 12 and pole piece 50, it is desirable to have the extremities of wings 30 abut the surface of housing 12 around opening 17. This is readily accomplished when control assembly 54 closes because of the force exerted on pole piece 50 causing it to move with respect to lever arm 52. The ball joint coupling provide three degrees of freedom of movement between pole piece 50 and lever arm 52. Typically, pole piece 50 is aligned with housing 12 the first time starter motor 10 is energized. Pole piece 50 then retains this relative position due to the friction between ball 42 and the surfaces of opposing openings 69 and 70.

It has been found that the reluctance of the flux path is sufficiently reduced that in some starters it is possible to eliminate the use of a shunt field. That is, special windings are not required for providing a pulling and holding force for pole piece 50. Thus, manufacturing cost are reduced. Further, the weight of starter motor 10 is reduced with respect to motors having such shunt fields. Still further, it is advantageously that the use of a ball joint assembly 40 eliminates the step of welding the pole piece to the lever arm.

Various alternative embodiments and variations will no doubt occur to those skilled in the art. For example, the particular coupling of the two side members of the lever arm may be varied from that disclosed herein. Additionally, the securing of the ball joint post to the pole piece can be done by deforming the pole piece about the post instead of deforming the post. The post can have a circumferential groove to receive deformed material from the pole piece. These and all other variations which basically rely on the teachings through which this disclosure has advanced the art are properly considered within the scope of the appended claims.

We claim:

1. An automobile starter motor having an armature and a housing in which is disposed at least one electric current carrying coil, said coil serving, in response to an initial flow of current through said coil, as a solenoid to selectively pull into a hole in the housing, a pole means coupled to the housing for responding to a magnetic field, the motor further having a starter drive assembly coupled to the armature for rotation therewith and lever means cooperating with the pole for controlling the position of the starter drive assembly axially of the armature, the improvement comprising:

a coupling means for connecting said pole means to said lever means including a ball joint means for providing an adjustable coupling, a post means extending outwardly from said ball joint means so that said pole means can pivot with respect to said lever means and said pole means can adjust to align in abutment with said housing thereby compensating for manufacturing tolerances and reducing flux path reluctance.

2. An automobile starter motor as recited in claim 1 wherein said lever means includes a pair of opposing side plates having opposing, parallel faces with opposing, aligned indentations therein receiving said ball joint means.

3. An automobile starter motor as recited in claim 2 wherein said indentations extend through said side plates and have opposing interior surfaces contoured to the shape of the outer surface of said ball joint means.

4. An automobile starter motor as recited in claim 2 wherein said lever means includes an attaching means extending between said side plates for securing said side plates to each other and applying a force to said ball joint means so that said ball joint means is movably secured between said side plates and can move to align said pole means with said housing and said hole in said housing and is sufficiently secured to resist relative movement between said pole and said lever means due to vibration.

5. An automobile starter motor as recited in claim 4 wherein said attaching means includes a pair of rivets extending between said side plates.

6. An automobile starter motor as recited in claim 1 wherein said post means includes an elongated member extending through a diameter of said ball joint means and extends beyond said lever means to connect to said pole means so that said pole means is spaced from said lever means, said post means including a transversely extending shoulder to limit movement of said pole means toward said lever means and said pole means including a tapered coupling with said post means for resisting movement of said pole means away from said lever means.

7. An automobile starter including:

a housing having a hole therethrough;

an armature rotationally mounted within said housing;

a field coil mounted in said housing for attracting magnetic material when said field coil is energized with an electric current;

a starter drive assembly coupled to said armature;

a lever pivotally mounted with respect to said housing and connected to said starter drive assembly so as to control the position of said starter drive assembly axially of said armature in response to the position of said lever;

a pole piece attached to said lever so that upon movement of said lever, said pole piece is aligned to pass through said hole, said pole piece having an elongated body with a generally U-shaped cross section, the two extremities of the U-shape extending out and down to form wing-like extensions to engage the housing and limit travel of said pole piece into said housing hole;

a ball joint means for attaching said pole piece to said lever, said ball joint means including a generally spherical ball, an elongated post extending outward from said ball and rigidly attached to the interior bottom portion of said U-shaped pole piece; and said lever including two generally L-shaped side panels placed along side each other, a first end portion being coupled to said starter drive assembly, an intermediate pivot means being pivotally coupled to said housing, a second end portion including a pair of opposing aligned openings one through each of said two side panels, the interior opposing surfaces adjacent said openings being curved to receive said ball, and a pair of rivets, one rivet on each side of said pair of openings for securing said two side panels to each other and securing therebetween said ball with sufficient force to prevent movement of said ball due to vibration of said pole piece and permit movement of said ball due to alignment of said pole piece when brought into contact with said housing so that there can be compensation for manufacturing tolerances and maximum seating of said pole piece on said housing thereby reducing flux path reluctance and equalizing flux distribution through both pole wing-like extensions.

8. An automobile starter as recited in claim 7 wherein said post includes a radially extending shoulder abuting said pole piece so as to limit movement of said pole piece toward said lever and said pole piece includes a tapered opening for receiving an end of said post, said end being deformable so as to limit movement of said pole piece away from said lever.

9. A method of operating a starting motor for an automobile wherein the starting motor includes a housing containing an armature and coil, a hole in the housing for receiving a pole piece connected to a lever which is pivotally mounted on the housing for moving a starter drive, said method including the steps of:

energizing the coil with an electric current;

attracting the pole piece to the hole in the housing;

pivoting with three degrees of freedom of movement the pole piece with respect to the lever so that the pole piece has maximum seating on the housing; and retaining the lever in a pivoted position with the pole piece seated on the housing so that the starter drive is engaged to start the automobile engine.

10. A method of operating a starter motor as recited in claim 9 wherein the step of pivoting includes:

applying a compressive force from two spaced members of the lever to a ball attached to the pole piece, the force being sufficient to resist movement due to vibration, and to permit movement due to engagement between the pole piece and the housing.

* * * * *